US005469796A

United States Patent [19]

Koenig

[11] Patent Number: 5,469,796

[45] **Date of Patent: * Nov. 28, 1995**

[54] MULTI-LAYER PANELS FOR MODULAR VAULT STRUCTURE

[75] Inventor: Donald E. Koenig, Hamilton, Ohio

[73] Assignee: Mosler, Inc., Hamilton, Ohio

[ * ] Notice: The portion of the term of this patent subsequent to Nov. 2, 2010, has been disclaimed.

[21] Appl. No.: 24,939

[22] Filed: Mar. 2, 1993

Related U.S. Application Data

[63] Continuation-in-part of Ser. No. 899,749, Jun. 17, 1992, Pat. No. 5,257,583.

[51] Int. Cl.[6] ..... E04B 2/02

[52] U.S. Cl. ..... 109/49.5; 52/463; 52/584.1; 109/79; 109/80; 109/84

[58] Field of Search ..... 109/79, 49.5, 80, 109/84; 52/462, 461, 463, 584.1

[56] References Cited

U.S. PATENT DOCUMENTS

| | | | |
|---|---|---|---|
| 2,089,059 | 8/1937 | Harley | 52/463 |
| 2,278,956 | 4/1942 | Wagner | 52/463 |
| 3,078,968 | 2/1963 | Frick | 52/463 |
| 3,782,053 | 1/1974 | Nakano et al. | 52/463 X |
| 5,031,374 | 7/1991 | Batch et al. | 52/462 X |

FOREIGN PATENT DOCUMENTS

| | | | |
|---|---|---|---|
| 209479 | 10/1908 | Germany | 109/80 |
| 664847 | 6/1964 | Italy | 52/584.1 |

*Primary Examiner*—Lloyd A. Gall
*Attorney, Agent, or Firm*—Wood, Herron & Evans

[57] ABSTRACT

A lightweight, multilayered panel for use in a modular vault or safe structure has multiple layers of cross-grained wood boards secured together by a grid of hardened masonry nails. The nails are driven into the panel layers from both major face surfaces of the panel and are angled from the perpendicular of the major face surfaces of the panel to increase the probability of a penetrating instrument striking a nail during a penetration attempt. The panel is covered in a layer of sheet metal, and a layer of Kevlar or some other ballistic resistant material is placed on one or more major face surfaces. Rabbet edges on the panel allow an assembly with reinforced seams, and two single panels may be secured together to form a double reinforced vault panel. Sturdy anchoring structures located in between the panel layers proximate and parallel to the edges of the panel receive securing structures when a batten is utilized to hold the panels together and in a completed vault structure, and to reinforce the strength of the seams between adjacent panels which are assembled together into a vault structure.

18 Claims, 5 Drawing Sheets

MULTI-LAYER PANELS FOR MODULAR VAULT STRUCTURE

RELATED APPLICATION

This application is a continuation-in-part of my application Ser. No. 07/899,749 filed Jun. 17, 1992, entitled Multi-Layer Panels for Modular Vault Structure which issued as U.S. Pat. No. 5,257,583 on Nov. 2, 1993. The disclosure of the aforesaid application is incorporated herein by reference.

FIELD OF THE INVENTION

This invention relates generally to vault and safe structures. Specifically it relates to an improvement in a lightweight, multi-layer panel, which improvement allows adjacent panels to be secured together in such a way as to make the overall vault structure more impenetrable.

BACKGROUND OF THE INVENTION

Vault and safe structures are utilized in a variety of applications to provide protection and safe keeping for valuable items, such as money, jewelry, confidential records and important documents. In addition to permanent vaults and safes of the monolithic type, like those often found in banks, some of the vault and safe structures used today are modular structures having multiple, detachable panels which are readily assembled to form the vault or safe. Modular vaults can be disassembled after a particular use and moved elsewhere, as necessary.

In the past, materials such as steel and concrete have been chosen for vault structures due to their characteristic strength and penetration resistance to a large variety of penetration devices. However, safe and vault structures made of steel or concrete or a combination thereof, are heavy and oftentimes difficult and time consuming to build or install. When the vault structure is modular and the vault panels are periodically assembled and dissembled, the difficulty with heavy materials such as steel and concrete is exacerbated. Additionally, since many vault structures today are used on the upper levels of high rise buildings, weight is an important factor in the overall desirability of the vault structure.

To achieve lighter vault panels, materials other than steel or concrete may be used. In the past, lighter panel material has meant a reduction in the penetration resistance achieved by the panel. However, not all vault structures are required to withstand prolonged penetration attempts by burglars. Many vault structures are utilized in areas which are under the surveillance of security personnel or otherwise protected by an electronic security system. Therefore, in these cases, the vault is sufficient if it deters a prospective burglar for the maximum time period necessary for the security personnel to observe the break-in attempt or for the alarm system to be triggered. To this end, modular vault structures are rated by Underwriter's Laboratories (UL), such as in test UL608 for Burglary Resistance Vault Doors and Panels, according to the amount of time that is necessary to breach the integrity of the vault panels and gain access to the internal chamber of the vault. For example, a UL rating of CLASS M is given to a modular vault panel which can withstand a break-in attempt for approximately 15 minutes, while ratings of Class 1, 2 and 3 correspond to a panel that can deter penetration for approximately ½, 1 and 2 hours, respectively. Successful penetration of a vault panel under U.L. standards is determined by the time it takes to make a hole in the panel of a size sufficient to allow the passage of an average human being through the opening, approximately 96 square inches. Modular vault structures are rated for a variety of cutting and torching tools, and greater or lesser penetration times are given other Class ratings.

Modular vault structures are usually composed of panels which fit together at their edges to create the walls, ceiling and sometimes floors of the vault. In modular vaults it is desirable to have panels which are dimensioned so as to be easily movable and sufficiently lightweight so allowing assembly and disassembly without the need for heavy machinery. While panels made of steel and concrete may sufficiently withstand penetration attempts for the desired time period, their increased weight and decreased mobility often makes them unsatisfactory for use in particular modular vault applications. It is therefore an objective of this invention to produce a lightweight modular vault panel which may be manufactured relatively inexpensively and will withstand attempts sufficiently to obtain the desired UL rating or a similar industry rating.

When various modular vault panels are fitted together at their edges to form a completed vault structure, the seam at which two adjacent panels meet may be the weakest point of the structure, and therefore, a logical point of attack for a person attempting to illegally enter the vault. In other words, the penetration resistance of a vault made of individual panels is often dictated by the maximum penetration resistance at the seams between adjacent panels. It is therefore desirable to have a lightweight vault panel such that the seams between adjacent connected panels have an impenetrability similar to the main body of the vault panel. With lightweight vault panels this is often difficult to achieve because the material used to make the vault panel is not as sturdy as heavier materials such as metal or concrete. Due to the reduced strength of lightweight materials, the fastening means holding adjacent panels together might be more easily defeated, allowing someone to enter the inner vault chamber without actually having to penetrate the main body of a vault panel. It is therefore a further objective of this invention to provide a vault panel which, when fitted together at its edges to form the wall, ceiling and floors of a vault, provides a seam which can withstand penetration attempts as well as the main body of the panel.

One prior art way of achieving a lightweight panel is to provide a multi-layered panel made of layers of wood overlying each other and joined together by nails or other fasteners. A typical example of such a structure is shown in Fee et al. U.S. Pat. No. 4,918,900 where 2"×4" boards are stacked and successively nailed together to form the main layer of the vault panel, while surface sheets are laid over the stack and secured thereto. The Fee panel uses a plurality of nails to interconnect the adjacent boards in the stack. The nails in the stack are also useful in resisting penetration attempts with sawing devices. However, since the nails extend essentially parallel to the main face of the panel and are spaced from one another in a repetitive grid, it is possible to make a cut through the panel without ever striking a nail. Additionally, the stack of 2"×4" boards has layers of wood with grains extending in the same direction, thus making chipping around the nails and through the panel a simpler task. Furthermore, the Fee panel shows metal interspersed between the boards of the stack making the panel more susceptible to attacks with a cutting torch because the metal enhances the operation of the torch by dispersing the heat of the torch uniformly over the entire body of the panel.

Consequently, it is an objective of the present invention to provide an improved lightweight, multi-layered wood panel for a modular vault structure which provides enhanced penetration protection over known wood panels. The panel should provide penetration resistance of both cutting and torching tools. Further, it is an objective to provide a panel where repetitiveness in its construction does not detrimentally affect the operation of the panel.

It is further an objective of the present invention to provide a panel including a unique construction around its edges so that when individual panels are assembled together into a vault structure, the seam between adjacent panels provides penetration resistance as good as or better than the main body of the panel.

SUMMARY OF THE INVENTION

In accordance with the objectives of this invention a panel for modular vault structures is disclosed having multiple board layers which are coextensive with each other to define a panel having edges and two major face surfaces. The layers of boards are nailed together with a plurality of nails which extend into the layers and are angled from the perpendicular of the major face surfaces of the panel so as to form a metal grid interspersed between the wood layers. A sheet metal skin encloses the board layers and the grid of nails, and the panel may further contain a layer of ballistic-proof material on one or more of its major face surfaces.

The boards used to make the layers of the panel have grains running along their length so that when they are stacked in alternating layers of vertical and horizontal extending boards, a panel is presented having multiple layers of cross-grained wood. Cross-grained wood layers increase the penetration resistance of the panel. The nails which are driven into the board layers to hold the layers together in a panel and to form a metal grid therein are preferably hardened steel masonry nails, and extend into all of the board layers of the panel but not completely through the panel so as to penetrate the other side. The nails are driven into the board at an angle from both major face surfaces of the panel to present a closely spaced metal grid throughout the panel layers, which increases the probability that a penetration device will strike a nail upon an attempted breach of the panel. The nails may be angled from the perpendicular of the major face surface of the panel both in the vertical direction and in the lateral direction therefore making it difficult, if not impossible, to make a straight horizontal or vertical cut of any distance along the major face surface of the panel without striking a nail. Alternatively, the nails may be angled in just one direction, either vertically or laterally, and they will still operate to thwart a penetration attempt because a successful breach of the panel requires cuts in both the vertical and lateral directions so as to make an opening.

At the sides of the panel, extending essentially proximate to and parallel to the horizontal and vertical edges, the panel contains elongated anchor members inserted in the middle layer of the panel which act as anchoring points for the fastener structures inserted into the panels to hold adjacent panels together into a vault structure. When the panels are adjoined together with batten strips and lag screws, the anchor members contain tapped and threaded holes into which the lag screws are fastened. These anchor members, generally made of steel, present a sturdier anchoring point for a fastening structure than the wood material of the panel. The anchor members are unitary elongated members which extend along the entire length of the panel sides to provide anchoring points anywhere along these sides.

In an alternative embodiment, the anchoring members may comprise a plurality of shorter elongated members which extend proximate to the panel edges in those places where it has been predetermined that a lag screw or other fastening structure will be inserted in forming the vault structure. The steel elongated anchor members are only wide as is necessary to accommodate a lag screw or other fasteners, and therefore, the anchor members enhance the penetration resistance of the seam without substantially increasing the weight of the panel.

In another embodiment of the present invention the panel edges are rabbeted so that when fitted together, the seams of the adjacent panels do not extend in a straight line into the internal chamber of the vault.

The panel of the present invention thereby presents a lightweight multi-layered panel for modular or permanent vault structures which will deter attempts to penetrate the vault for a particular time period. In an alternative embodiment of the present invention, an enhanced panel with a higher UL rating is achieved by placing two of the disclosed panels coextensive with each other to create a doubly thick reinforced vault panel, having tongue and groove edges that are fitted together to form the vault structure.

DETAILED DESCRIPTION

Figure 1:
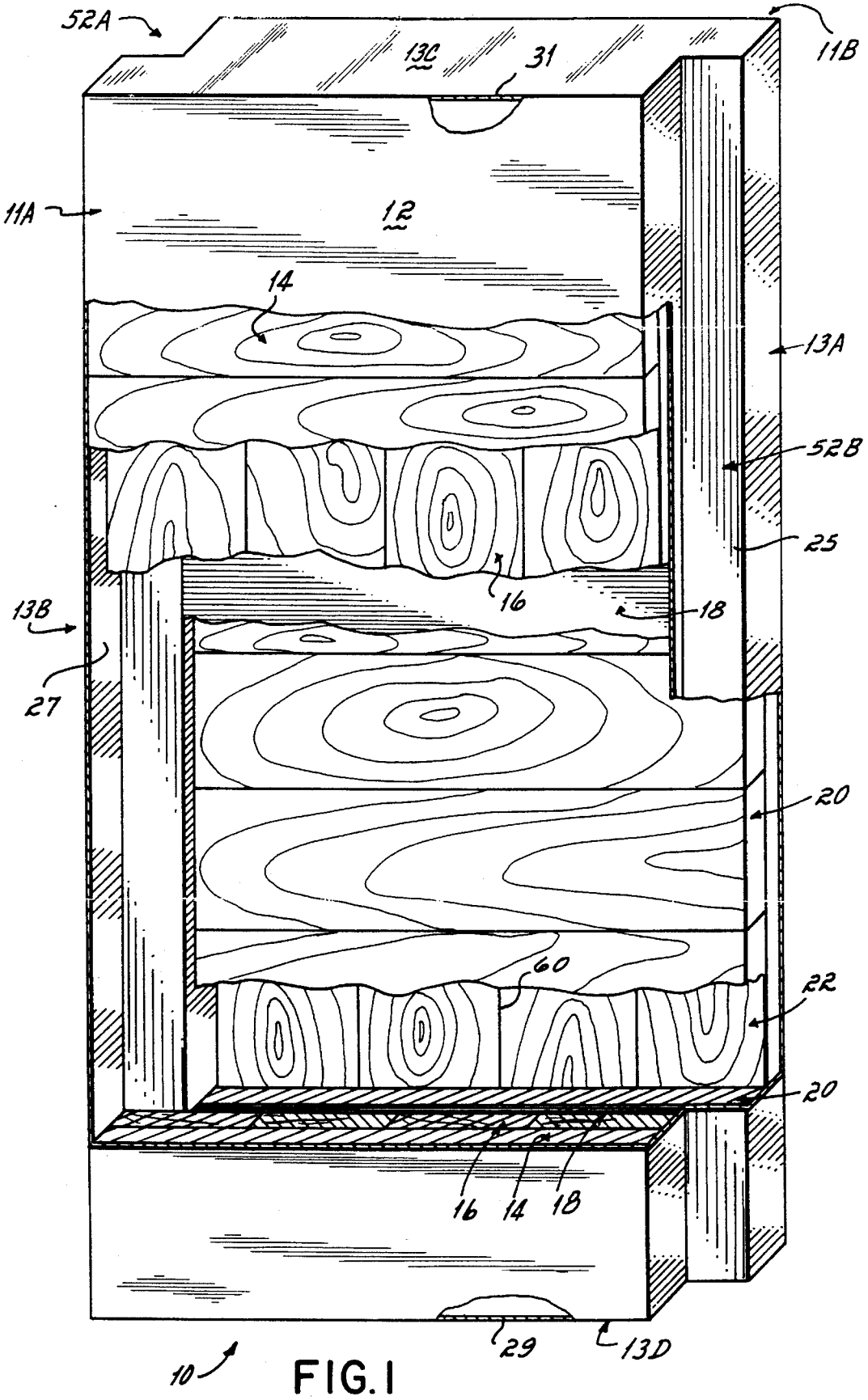
FIG. 1 is a perspective view of the front, right side and top of the panel of the present invention, partially broken away at several locations to reveal different features of its construction in different regions of the panel.

Referring to an embodiment of the present invention as shown in FIG. 1, a multi-layer, or sandwich, panel 10 has a pair of parallel major face surfaces 11A and 11B (only one of which, 11A, is shown in FIG. 1), and opposite vertical edges 13A and 13B, and upper and lower horizontal edges 13C and 13D. Panel 10 has a sheet metal skin 12, a first layer of horizontal wood boards 14, and a second layer of vertical wood boards 16 which underlie horizontal boards 14. A wood spacer layer or panel 18 is shown, followed by a third layer (second horizontal layer) of wood boards 20 which overlies a fourth layer (second vertical layer) of wood boards 22. A sheet metal skin 24 underlies the second vertical board layer 22 and covers the second major face surface 11B of the panel. The layers of horizontal and vertical boards 14, 16 and 20, 22 are secured together by two networks or arrays of nails 30, 32, to be described in greater detail hereafter. The nail works extend from opposite directions into both major face surfaces of the horizontal and vertical boards interiorly of the metal skins 12 and 24 (see FIG. 3) so as to collectively provide an array or grid of metal nails throughout the panel layers which offers enhanced penetration resistance.

The wood utilized for the vertical and horizontal boards 14, 16, 20 and 22 of panel 10 is chosen to provide maximum penetration resistance and minimum weight so that the overall panel 10 remains relatively lightweight and portable as is desired for modular vault structures. Preferably, the boards are made of hardwood such as oak, hickory or sugar maple, which are superior to soft woods in strength and overall attack resistance. Also, the boards are preferably planed prior to assembly of panel 10 so that voids between adjacent layers of horizontal and vertical boards, ( e.g., between layers 14 and 16) are minimal, to produce a fight, compact assemblage of boards in panel 10. The layers of hardwood boards 14, 16, 20 and 22 have wood grains preferably alternating in direction from layer to layer throughout the thickness of the entire panel 10. For example, and as best illustrated in FIG. 1, the grains extend lengthwise on the boards so that when the boards are assembled into a panel 10, the alternating layers of vertical, 16 and 22, and horizontal, 14 and 20, boards are cross-grained from layer to layer because the grain of one layer may extend vertically while the adjacent layers may have horizontally extending grains. Alternating the direction of the grains provides extreme toughness in the panel similar, for example, to laminated plywood. The thickness of each of the individual boards in layers 14, 16, 20 and 22, is approximately one inch so that, for example, within a panel having a four-inch thickness, four layers of boards are utilized, although thicker or thinner boards may work as well. When the assemblage of board layers 14, 16, 20 and 22 and spacer layer 18 has been assembled into a panel 10 with alternating layers of horizontal and vertical boards nailed together, the entire panel 10 (i.e., the major face surfaces 11A and 11B and the edges 13A, 13B, 13C and 13D) is covered with a skin of sheet metal, such as 16 gauge sheet steel, to add yet another layer of penetration resistant material to panel 10. Referring again to FIG. 1, the metal skin includes front and rear skins 12 and 24, opposite side skins or caps 25 and 27, and bottom and top skins 29 and 31. Furthermore, as will be described below, the outside metal skin allows adjacent juxtaposed panels 10 to be welded together along their edges 13A, 13B, 13C and 13D when several panels 10 are assembled into a vault or other structure.

Figure 2:
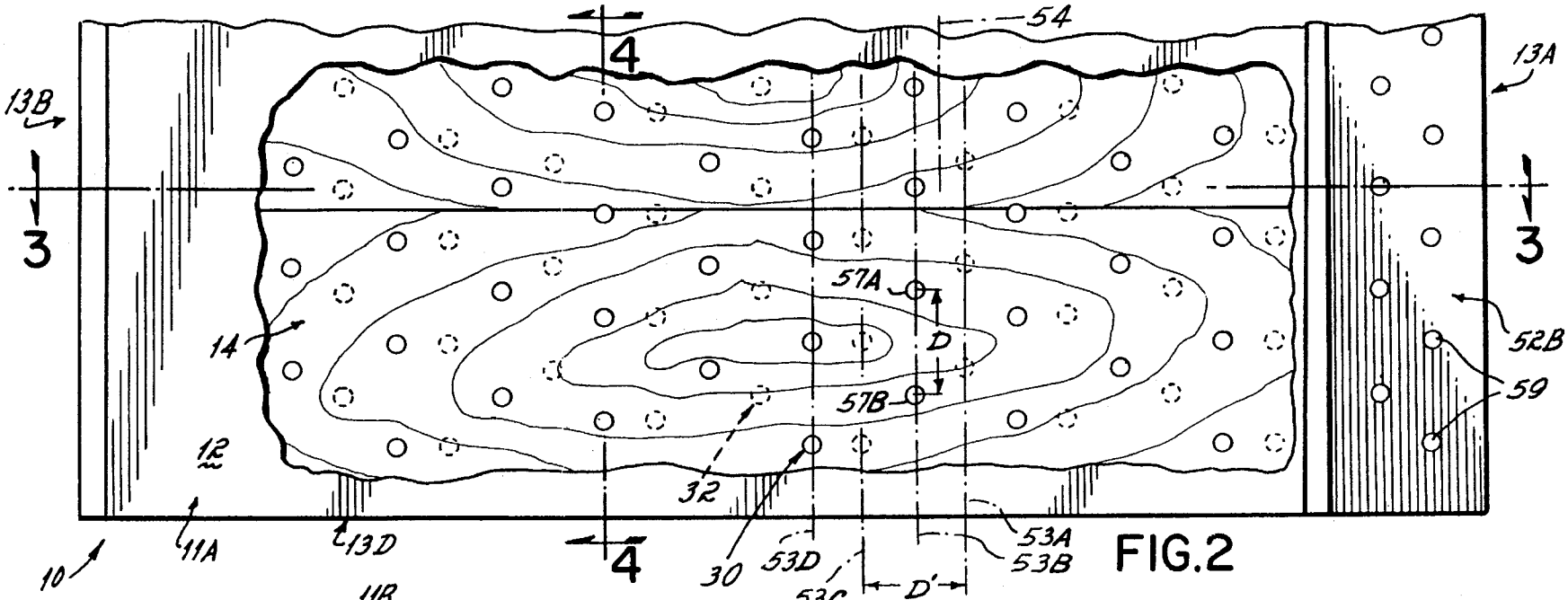
FIG. 2 is a front elevational view, partially cut-away, of the panel of the present invention showing the nailing pattern.

As seen in FIG. 1, panel 10, when fully assembled, has four edges 13A, 13B, 13C and 13D and two major face surfaces 11A and 11B. Referring to FIG. 2, the layers of Wood boards 14, 16, 20 and 22 are held together by a front array of nails 30 which are driven into the panel 10 from face surface 11A and a rear array of nails 32, which are driven into the panel 10 from face surface 11B before the sheet metal skins 12, 24 are affixed to the panel 10. Each nail of arrays 30 and 32 penetrates into all the board layers 14, 16, 20 and 22 of panel 10 to hold the layers together but are dimensioned in length so as to not penetrate completely through all of the layers. The nails of arrays 30 and 32 are preferably hardened steel nails, such as number 9 gauge, hardened, spiral-fluted shank concrete nails available from Dixon Weatherproof Nail Co. of Evanston, Ill., which function to collectively create a grid of metal throughout panel 10 to increase the resistance of panel 10 to penetration attempts using cutting tools such as carbide tipped saws. The nails of arrays, 30 and 32, are nailed into layers 14 and 22, respectively, in opposite directions through the layers of hardwood boards 14, 16, 20 and 22 and the spacer layer 18 such that when they are fully driven in, the heads of the nails 30 and 32, are flush with the outer surfaces of board layers 14 and 22, respectively. As such, the heads of nails 30 lie adjacent the interior surface of metal skin 12, while the heads of nails 32 lie adjacent the interior surface of metal skin 24.

Prior art panels using nails which extend in a pattern throughout the panel have a problem in that a cut may be made in a straight line between the nails upon determining the spacings in the pattern by successive penetration attempts. The ability to make straight line cuts both vertically and horizontally allows easier penetration of the panel.

Figure 4:
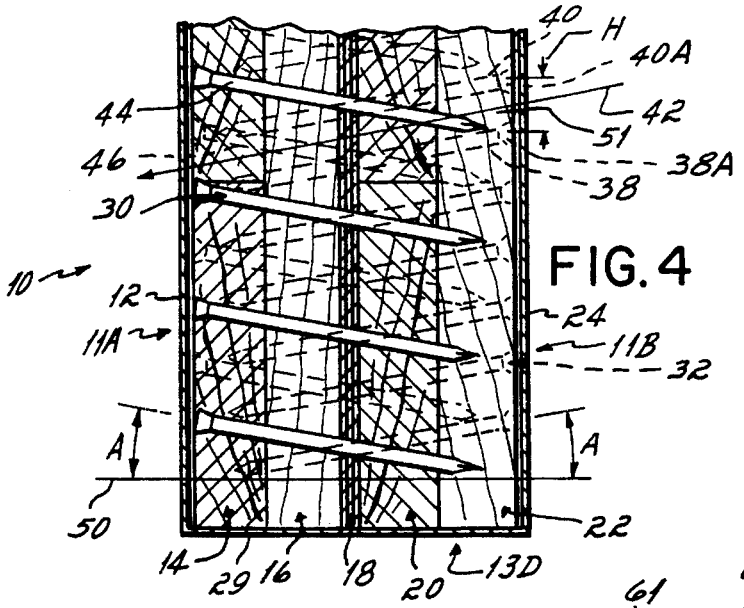
FIG. 4 is a side cross-sectional view of the panel of the present invention made along lines 4—4 of FIG. 2.

Referring to FIG. 4, the nails of arrays 30 and 32 extend at an angle, A, to any imaginary horizontal plane 50 which is perpendicular to the major face surfaces 11A and lib of panel 10. The individual opposing angled nails of arrays 30 and 32 cooperate to reduce the likelihood of penetrating panel 10, such as by making a horizontal cut extending, between adjacent nails 38 and 40 and completely through layers 14, 16, 18, 20 and 22 of the panel 10. A horizontal cut in surface 11B might be started between heads 38A and 40A of nails 38 and 40, thus avoiding the heads of these nails; however, the blade (not shown) making the cut would strike the bodies of nails 38 and 40 which enter the panel layers from face surface 11B or would strike nails 44 and 46 entering panel 10 from face surface 11A. Furthermore, a cut in surface 11B made downward along imaginary line 42 may miss nails 38 and 40 and their associated heads 38A and 40A but at least will strike nails 44 or 46 which are nailed into panel 10 from face surface 11A. In this way, angled nails 44 and 46 effectively intersect the gap 51 which exists between nails 38 and 40. Similarly, an identical cut between adjacent nails 44 and 46 in face surface 11A would strike nails 38 and 40 extending into panel 10 from face surface 11B. Therefore, the downward (as viewed in FIG. 4) angling of the individual nails of arrays 30 and 32 provides a panel 10 which is more difficult to penetrate than a panel having nails extending perpendicular to the major face surfaces, 11A and 11B of panel 10. The nail arrays 30 and 32 are preferably angled from plane 50 approximately 10 degrees, and each nail extends completely through all layers of the panel 14, 16, 18, 20 and 22 except the final layer which is opposite the nail head (for example, face surface 11A is opposite nail head 38A in FIG. 4). Thus, each nail of arrays 30 and 32, is essentially embedded in all of the layers of panel 10.

Figure 3:
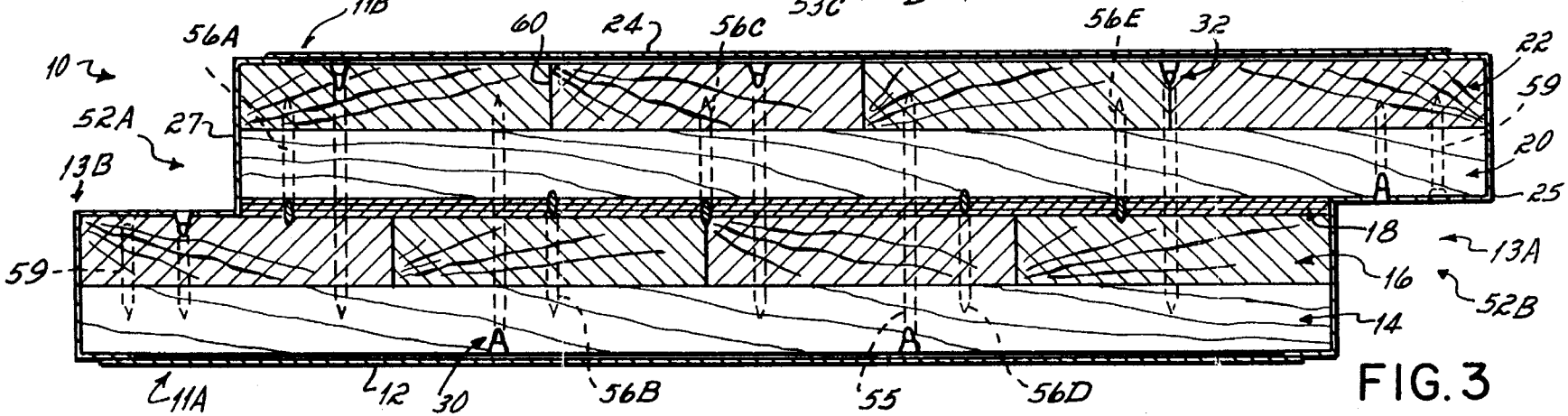
FIG. 3 is a top cross-sectional view of the panel of the present invention made along line 3—3 of FIG. 2.

Referring again to FIGS. 2 and 3, a cutting instrument, such as a circular saw, making a cut (such as along line 3—3 in FIG. 2) along either major face surface, 11A or 11B, of panel 10 will strike nails of either array 30 or 32 or both, damaging and possibly permanently destroying the blade of the cutting instrument. For example, as illustrated in FIG. 3, while nails such as 55 may be missed by the cutting instrument's blade, adjacent nails such as 56A and 56B will be struck along their length by the blade of the instrument. Furthermore, along a straight line cut in the panel 10 (line 3—3 in FIG. 2), several nails 56A, 56B, 56C, 56D and 56E, for example, will be struck. As stated above, preferably the nails of arrays 30 and 32 used to construct panel 10 are number 9 gauge, spiral-fluted, hardened steel concrete nails which are difficult to remove from the board layers 14, 16, 20 and 22 of panel 10 once driven therein. The large diameter of the hardened nails resists attacks from sophisticated cutting instruments, such as circular saws and chainsaws having carbide blades or carbide blade tips.

Referring again to FIG. 4, the individual nails of nail arrays 30 and 32 are shown angled downwardly from the top edge 13C of panel 10, so that a horizontal cut in panel 10 intercepts the head or bodies of particular nails as discussed above. A successful breach in a vault panel, in relation to the rating system of Underwriters Laboratories, is defined as an opening or hole approximately 96 square inches in dimension. Such an opening requires both vertical and horizontal cuts in the panel 10. Therefore, preventing a horizontal cut in panel 10 effectively deters penetration of the panel of the present invention, so that the panel 10 achieves the desired UL rating, because preventing a cut in one direction deters an opening from being established in the panel.

Figure 7A:
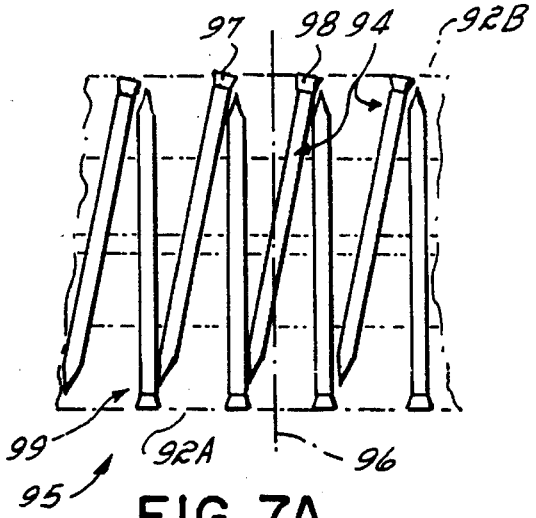
FIG. 7A is a diagrammatic partial top view of an alternative embodiment of the panel of the present invention, the view being similar to a fragment of FIG. 3.
Figure 7B:
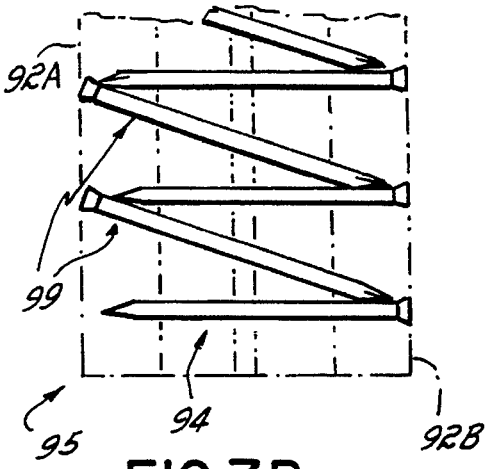
FIG. 7B is a diagrammatic partial side view of an alternative embodiment of the panel of FIG. 7A.

Turning now to FIG. 3, with the nails of arrays 30 and 32 angled only downwardly, it may be possible to make vertical cuts in panel 10 between the vertical columns of nails 53A and 53B, such as along imaginary line 54, without striking a nail. That is, the gaps existing between the vertical columns of nails 53A and 53B, for example, are not traversed by nails because the nails of arrays 30 and 32 in a first embodiment are not angled laterally. In alternative embodiments of the present invention, as shown in FIGS. 7A, 7B, 8A and 8B, the nails of arrays 30 and 32 are angled both laterally from side to side and vertically downward. FIG. 7A shows a partial top view of an alternative embodiment of the panel of the present invention, similar to a fragment of FIG. 3, wherein the nails of array 94 extend into face surface 92B of panel 95, angled laterally from the perpendicular 96 of face surface 92B. The lateral angling of nails 94 prevents a vertical cut, such as along imaginary perpendicular line 96 between individual nailheads 97 and 98, from penetrating panel 95 without striking a nail FIG. 7B shows a partial side view of the panel 95 of FIG. 7A, similar to the cross-sectional view of FIG. 4. When panel 95 is viewed from the side, the nails of array 99 are seen to angle vertically downward from the top of the panel 95. The nails of array 99 of FIG. 7B are similar to the nails of array 94 in FIG. 7A, differing only in the sense that they prevent a horizontal cut from extending through the panel and into the vault rather than preventing a vertical cut as does array 94. Therefore, in the embodiment of the invention shown in FIGS. 7A and 7B, cuts in both directions, vertical and horizontal, are prevented due to the angling of the nails of arrays 94 and 99.

Figure 8A:
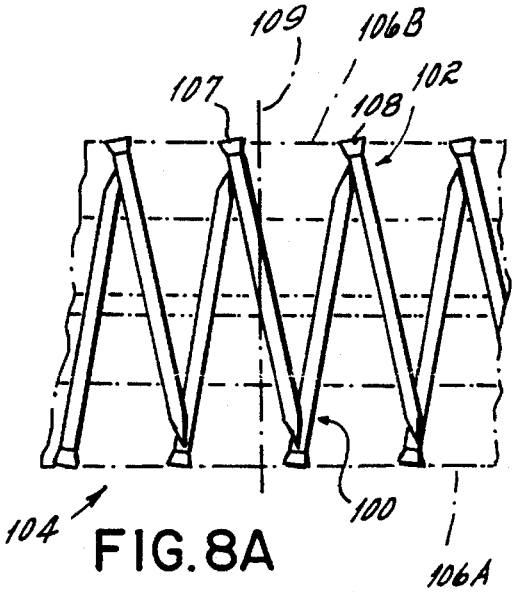
FIG. 8A is a diagrammatic partial top view of another alternative embodiment of the panel of the present invention, the view also being similar to a fragment of FIG. 3.

In still another embodiment of the present invention, the nails of both arrays 100 and 102 of panel 104 are angled both laterally from side to side and vertically downward to prevent a breach of the panel 104. For example, the partial top view in FIG. 8A shows the nails of arrays 100 and 102 angled laterally to prevent a vertical cut down along one of the major face surfaces 106A or 106B between nailheads 107 and 108 along imaginary line 109. Similarly, in the partial side view in FIG. 8B the nails of arrays 100 and 102 are also angled vertically downward so as to simultaneously prevent horizontal cuts in the panel 104. In this way, a panel of the present invention is presented which provides increased penetration resistance over a panel which has nails angled only in one direction, vertically or laterally.

In a panel, such as panel 10 of the present invention, having interspersed arrays or grids of nails extending therein to deter penetration, the density of nails in the grids is an important parameter. As shown in FIG. 2, nails of arrays 30 and 32 are driven into panel 10 in laterally spaced vertically extending columns such as 53A, 53B, 53C and 53D where an individual nail 57A is vertically spaced apart a distance D, preferably about an inch and a half, from an adjacent nail 57B. The vertical columns of nails, e.g., 53A and 53C, which extend into the panel 10 from the same major face surface 11B are laterally spaced from each other a distance D', which is also preferably an inch and a half. The nails of array 30 are driven into face surface 11A of the panel 10 in vertical columns, e.g., 53B and 53D, having approximately the same vertical spacing D between each nail as the nails in the vertical columns 53A and 53C in array 32, and approximately the same lateral spacing D' between the vertical columns of nails as between the vertical columns of nails in array 32 driven into face surface 11B. However, between the two face surfaces 11A and 11B, the vertical columns of nails 30 in face surface 11A are laterally offset approximately one-half of the distances D', or preferably ¾ inch, from the vertical columns of nails 32 driven into face surface 11B. Similarly, opposing vertical columns on opposite sides of the panel are also vertically offset from each other about one-half of the distance D. Therefore, since the nails are driven into panel 10 from both major face surfaces 11A and 11B of panel 10, the effective horizontal nail spacing of the nail arrays 30 and 32 in panel 10 is ¾ of an inch.

Figure 8B:
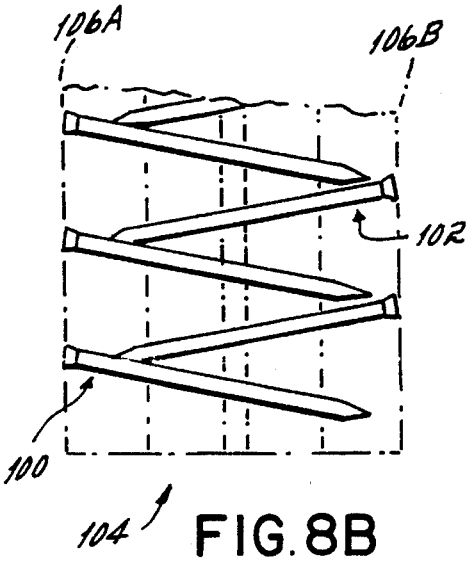
FIG. 8B is a diagrammatic partial side view of the alternative embodiment of the panel of FIG. 8A.

Turning now to the angling of the individual nails in arrays 30 and 32, although a nail angle of approximately 10 degrees is disclosed, any angle may be used. As may be appreciated, however, the amount of angling of the nails of arrays 30 and 32 from the perpendicular 50 to the face surfaces of panel 10 affects the maximum spacing between nails which may be utilized to maintain the effectiveness of the nail grid. Referring again to FIG. 4, if the angle, A, between the individual nails and the perpendicular 50 to the face surfaces of the panel 10 is increased, more of the length of a particular nail underlies the length of an adjacent nail. For example, with a greater angular slant of nail 40, more of the length of nail 40 underlies the length of nail 38 and, as a result, more individual nails extend across any gaps, such as gap 51, which exist between adjacent nails. Consequently, the spacing distance H between the heads 38A and 40A of adjacent nails 38 and 40 may be increased while still maintaining an effective nail array because the greater angling allows nails such as 44 and 46 to extend across gap 51 which exists between nails 38 and 40 from a further lateral vertical distance away than if the nails were angled laterally or vertically to a lesser degree. Therefore, greater angling of the nails allows the individual nails in an array to be spaced further from each other both vertically and laterally while still maintaining an effective nail grid in panel 10. Further, as is appreciated, when the angle, A, of the nails increases, the nails themselves may have to be increased in length so as to still extend completely into all of the layers of panel 10. As stated above, while it is preferable to have the nails of arrays 30 and 32 angled both vertically and laterally (as shown in FIGS. 8A and 8B) angling the nails in only one direction will normally be sufficient to achieve the desired penetration resistance rating, assuming adequate nail density in the panel. Furthermore, increasing the distances D or D' between adjacent nails on the same face surface without increasing the angling of the nails may also be sufficient to provide a panel which achieves the desired penetration resistance rating, although the desired effects of angled nails is reduced if the spacing D or D' is increased to the extent of not having nails of array 30 extend into the gaps between nails of array 32 and vice versa. Consequently, the angling of nails and the spacing between adjacent nails are parameters which may be changed interactively without defeating the objective of the present invention.

In penetration attempts of vault and safe structures, the use of cutting torches is common. A shortcoming of prior art panels which utilize metal layers between layers of wood, is that the metal layers effectively distribute the heat of the cutting torch throughout the body of the panel and actually enhance the penetration effect of the torch. The panel 10 of the present invention does not utilize metal layers between the layers of hard wood, thus providing increased resistance to a torch attack.

Turning now to assembly of the panel, in FIG. 1 panel 10 is assembled by laying a first layer of boards 22 flat and lengthwise adjacent to one another so that no gaps exist between the lengthwise adjacent edges 60 of the individual boards (see FIG. 1). The vertical boards preferably have a width of approximately 6 inches, a length of 8 feet and a thickness of 1 inch. A second layer 20 of shorter horizontal boards (approximately the same dimensions of the vertical boards except preferably only 2 to 3 feet long) are laid down adjacent each other to overly layer 22. The horizontal boards of layer 20 are placed essentially perpendicular to the boards of vertical layer 22, and thus the length of the horizontal boards determines the width of panel 10. The wood grains of the boards are preferably along the length of the boards, so that by alternating layers of horizontal and vertical boards, a panel 10 having multiple cross-grained layers of wood is created. Next, an optional filler layer 18 may be placed over the second horizontal layer of wood 20. The filler layer 18, such as plywood, is utilized to present a space between the second and third layers of boards, 20 and 16, to accommodate the thickness of a Z-shaped metal angle iron 72 (FIG. 5) which may be used between the edges of adjacent panels to connect the panels together into a vault structure as will be described below. However, a spacer layer 18 is not necessary for the operation of the panel. Another layer of vertical boards 16 overlies layer 20 or spacer layer 18 to form a third layer of boards which extend essentially parallel to the boards of layer 22 and essentially perpendicular to the boards of layer 20. A fourth layer of horizontal boards 14 is placed crosswise over third layer 16 similar to layer 20 overlying layer 22. The layers of boards 14, 16, 20, 22 and optionally spacer layer 18, are then nailed together by the arrays 30 and 32 of masonry nails to secure the assemblage of board layers tightly together in a panel 10. The arrays of nails, 30 and 32, may be driven into the layers of panel 10 manually or by an automated nailing machine such as the Doig 60-14 nail machine from William S. Doig Inc. of Hewitt, N.J. The nails are angled as described above to collectively form a metal grid interspersed between the board layers. The panel 10 is assembled by nailing one major face surface 11A with an array of nails such as array 30, and then flipping the panel 10 to nail into the other face surface 11B with array 32 of nails.

Figure 1A:
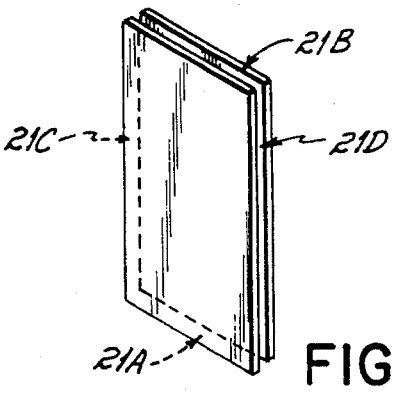
FIG. 1A is a perspective view of the front fight side and top of the panel of the present invention showing rabbet edges on both the horizontal and vertical sides of the panel.

Referring to FIG. 3, the preferred embodiment of the panel of the present invention has rabbet edges 52A and 52B so that the panels interact when assembled into a vault structure (FIG. 5) to present a seam which does not extend straight into the inner chamber of the vault. Rabbet edges 52A and 52B are achieved in panel 10 by staggering the third 16 and fourth 14 layers of boards from the first 22 and second 20 layers of boards. For example, to create a rabbet edge along the vertical edges 13A and 13B of panel 10 (see FIG. 1), the two layers of boards, 20 and 22, are staggered laterally from side to side with respect to layers 14 and 16. Similarly, to create a rabbet edge on the horizontal edges 13C and 13D of panel 10, the two layers of boards, 20, 22, are staggered vertically from top to bottom with respect to the other two layers of boards, 14 and 16. FIG. 1A shows a panel having both horizontal 21A and 21B and vertical 21C and 21D rabbet edges. At the rabbet edges 52A and 52B, shorter nails 59, of the same material as the panel nails, are used to extend through only two layers of the panel (see FIG. 3).

When panel 10 is assembled, the entire panel 10 is covered with a skin of sheet metal, such as 16 gauge sheet steel, to add yet another layer of penetration resistant material to panel 10. As seen in FIG. 3, sheet metal 12 and 24 covers both major face surfaces 11A and 11B while sheet metal caps 25, 27 are placed over the rabbet edges 52A and 52B. Additionally, one or more of the face surfaces 11A or 11B (preferably the face surface that is to face the inside of the vault structure), is covered with one or more layers of ballistic resistant material 65 (shown in phantom lines in FIG. 5), such as Kevlar, a brand of ballistic resistant material available from Du Pont Chemical, to prevent the penetration of a projectile into the vault which has been directed into the vault from outside thereof.

Figure 5:
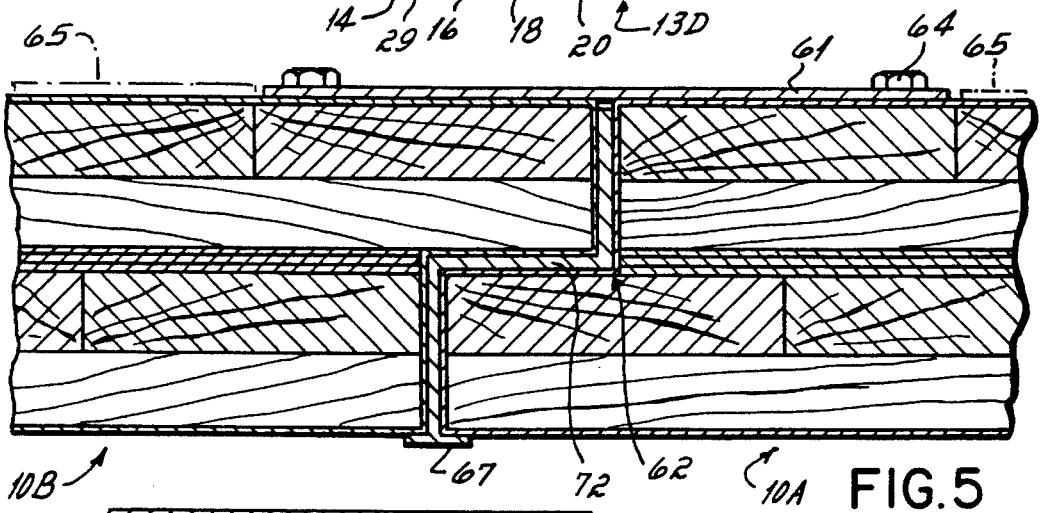
FIG. 5 is a top plan view of an assembly of two juxtaposed panels of the present invention.

Referring to FIG. 5, when assembling the panels 10 into a vault structure, the panels 10 are connected together using metal batten strips 61 which extend over the length of the seam 62 where the rabbet edges 52A and 52B of adjacent panels 10A and 10B meet. The batten strips 60 are connected to the panels by lag screws 64 or other appropriate fasteners on the inside of the vault so as to prevent disassembly of the panels by someone on the outside of the vault. In one embodiment of the invention, a metal Z-bar 72 extends along the length of seam 62 between adjacent panels 10A and 10B to provide additional penetration resistance at seam 62 although the Z-bar 72 is not necessary for the integrity of panel 10. In a vault assembly using the Z-bar 72 along seam 62, the panels 10 require a filler layer 18 of plywood or some other suitable material between the second and third layers of boards, 16 and 20, respectively in FIG. 5, to account for the thickness of the middle section of Z-bar 72 and make the panels mount flush at the seam 62. An end piece 67 of Z-bar 72 covers the outside seam of the panels when the vault is assembled. In an assembly of panels which does not use a Z-bar 72 at seam 62, the filler layer 18 is unnecessary and a 16 gauge steel batten strip 61 is used to cover the exterior joints. The exterior batten (not shown) similar to the batten 61 is mostly for appearance and does not greatly affect the security of a vault built with the panels of the present invention 10.

When the adjacent panels 10 of FIG. 5 are assembled into a completed vault structure, the metal batten strips 61 are anchored to the panels 10 by lag screws 64 which extend into the wood layers 14, 16, 20, 22 from either side of the panel 10. The penetration resistance of the vault structure at the seams between the adjacent panels 10 are directly affected by the anchoring strength of the wood panel layers because these layers hold the lag screws 64 securely in the panel and, in turn, hold the batten strips 61 securely to seam 62 to keep adjacent panels firmly together into a vault structure. The seams between panels of a vault, if their locations are known to a person trying to illegally gain access to the inside of the vault, are often an attack point due to the perception that the seam 62 will not maintain the inherent penetration resistance that is encountered in the main body of the panel 10. That is, a perspective burglar may perceive that the panels may be easily pulled apart or otherwise separated at their seams 62 to allow vault penetration without having to breach the panel 10 itself. This perception is further supported in the mind of the prospective burglar if he knows that the panels 10 are lightweight panels made of wood layers and that sufficient force at the seam 62 may be sufficient to tear the lag screws 64 from the wood layers of the panel 10. While a panel made of steel or some other sturdy material may anchor the lag screws 64 more securely and offer a seam 62 with enhanced impenetrability, steel or another such similar material would be very heavy and inadequate as a lightweight panel material.

Figure 9:
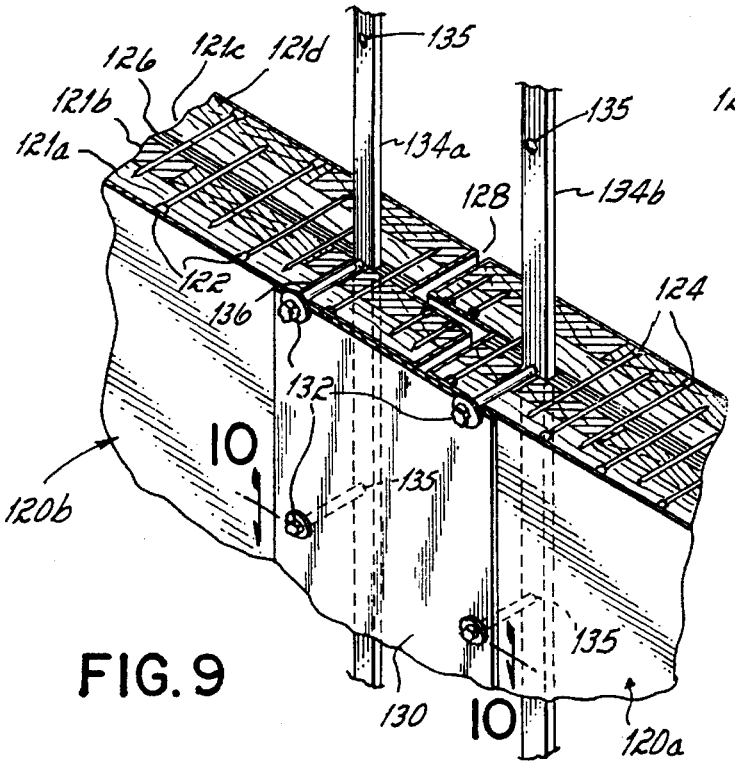
FIG. 9 is a cross-sectional perspective view of the panel of the present invention showing the steel anchor members embedded in the center layer of the panel.

The panel of the present invention enhances the strength of the seam between adjacent lightweight panels by including metal anchor members which extend parallel with and proximate to the panel edges for anchoring the lag screws or other fasteners holding the panels together when a batten is used to secure the panels together in a vault structure. Referring now to FIG. 9, adjacent panels 120*a*, 120*b* are somewhat similar to panel 10 of FIG. 1 and comprise wood panel layers 121*a*, 121*b*, 121*c*, 121*d* with grids of angled nails 122 and 124 extending at an angle into the panels from opposite face surfaces to enhance the penetration resistance of the panels. Each panel, (e.g. 120*a*) also includes a center layer 126 which may be made of wood or some other suitable material. As shown in FIG. 9, when a vault is assembled from the panels of the present invention, two adjacent panels 120*a* and 120*b* are placed so that adjacent rabbet edges of the panels abut to form seam 128. The panels 120*a* and 120*b* are secured together by a batten strip 130 which is anchored to the individual panels 120*a*, 120*b* by a plurality of lag screws 132. The lag screws 132 extend through openings 133*a* and 133*b* in batten strip 130 and through layers 121*a* and 121*b* and into center layer 126. Similarly, from the other side of the panels 120(*a–b*), the lag screws might extend through layers 121*c* and 121*d* and into center layer 126. Embedded in center layer 126 of panels 120*a* and 120*b*, proximate to and parallel with the rabbet edges of these panels and seam 128 are elongated anchor members 134*a* and 134*b*. The anchor members 134(*a–b*) each have threaded holes 135 tapped therein which receive the plurality of threaded lag screws 132 so as to provide a sturdier construction at the seam 128 than is possible without the anchor members.

In a preferred embodiment of the panel, the anchor members 134*a*, 134*b* are made of steel or an appropriate metal that has a greater hardness and greater durability than the wood layers 121*a*, 121*b*, 121*c*, 121*d* and 126 of the panels. In this way, the lag screws 132 holding panels 120(*a–b*) together at seam 128 are more securely anchored and more difficult to remove than if they were threaded into the wood layers. This increases the strength and impenetrability of the seam 128, and thus increases the overall impenetrability of the vault structure made with panels 120(*a–b*).

Figure 10:
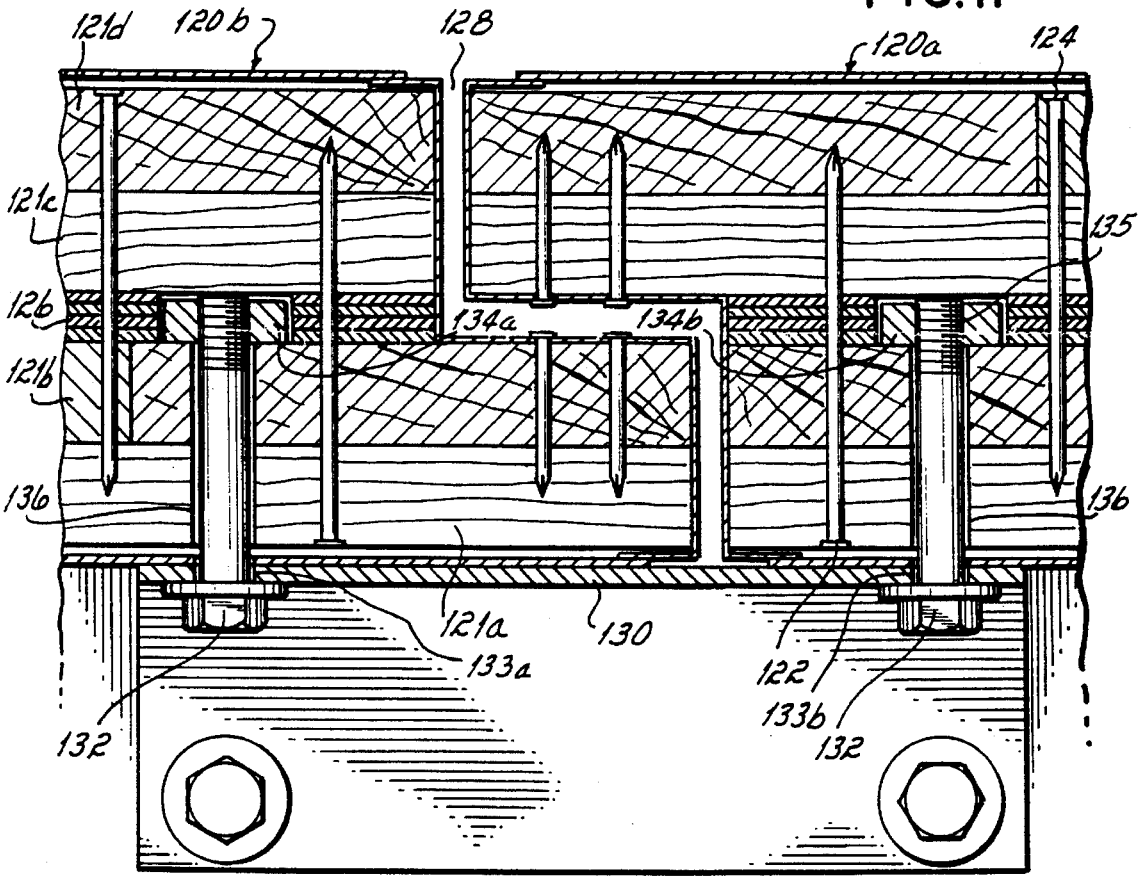
FIG. 10 is a top cross-sectional view of the panel of the present invention along lines 10—10 of FIG. 9.

The anchor members 134*a*, 134*b* are preferably steel strips approximately 1" wide and ⅜" thick which contain drilled and tapped holes 135 along their lengths to receive lag screws 132. Referring to FIG. 10, lag screws 132 extend through batten openings 133*a–b* and through a bore or channel 136 in the wood layers 121*a*, 121*b* of the panels. Channel 136 and openings 133(*a–b*) are dimensioned to accommodate the width of lag screws 132 without binding them so as to make vault assembly easier. Moreover, the anchor members 134(*a–b*), which are embedded in center layer 126, are only as wide as is necessary to accommodate the lag screws 132 and provide sufficient anchoring. In this way, the panels 120(*a–b*) remain generally lightweight even with the metal anchor members. By more sturdily securing the lag screws, 132 to the panel members 120(*a–b*) at the seam 128, anchor members 134*a*, and 134*b* enhance the operation of a vault made using the panels of the present invention.

Figure 11:
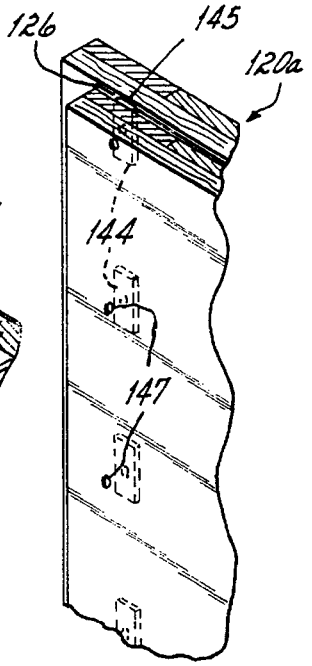
FIG. 11 is a fragmentary perspective view of an alternate anchor member.

Preferably, the metal anchor members 134*a* and 134*b* extend the entire length of the panels 120(*a–b*) essentially parallel with and proximate to the rabbet edges of the panels and to seam 128. This allows the panels 120(*a–b*) to be secured together anywhere along the length of seam 128, as the threaded holes 135 can be placed anywhere along the anchor members. However, in an alternative embodiment as shown in FIG. 11, the elongated anchor members 134*a*, 134*b* may be replaced with a plurality of shorter elongated pieces 144 secured in pockets or recesses 145 in center layer 126. These pieces 144 extend in an end-to-end manner substantially from the top of the panel to the bottom of the panel. The individual anchoring pieces 144 extend along the edges of the panels 120(*a–b*), and are placed only at those edge positions where it has been predetermined that a lag screw 132 will be embedded to hold the panels together. Further, each member 144 contains a threaded hole 147 to receive a lag screw 132. The anchor members 144 anchor the lag screws 132 sufficiently therein, and thus, more firmly secure the panels 120(*a–b*), together at seam 128 when a batten 130 is placed over a seam between adjacent panels to hold the panels together in a vault structure.

In a vault structure made using the panels of the present invention, a prospective burglar must physically delaminate panels 120(*a–b*) layer by layer in order to defeat the vault panels at seam 128 and penetrate inside the vault structure. A problem with lightweight panels in the past has been securing the panels together into a vault structure in a way such that the vault is not easily attackable in the region of the seams between adjacent panels. This problem is particularly critical when the panels are made of wood layers. The panels of the present invention overcome this problem by utilizing sturdy metal anchoring members at their edges while still maintaining the light weight characteristics of a predominantly wood panel.

In an alternative assembly of panels 10A and 10B, the panels are welded at points along the length of seam 62 on the inside of the vault eliminating the need for batten strips 61. The welds (not shown) are made to the sheet metal skin which covers the inside face of the panels 10A, 10B. The floor panels and ceiling panels, when assembled into a vault, are connected to the wall panels using angle irons (not shown).

Figure 6:
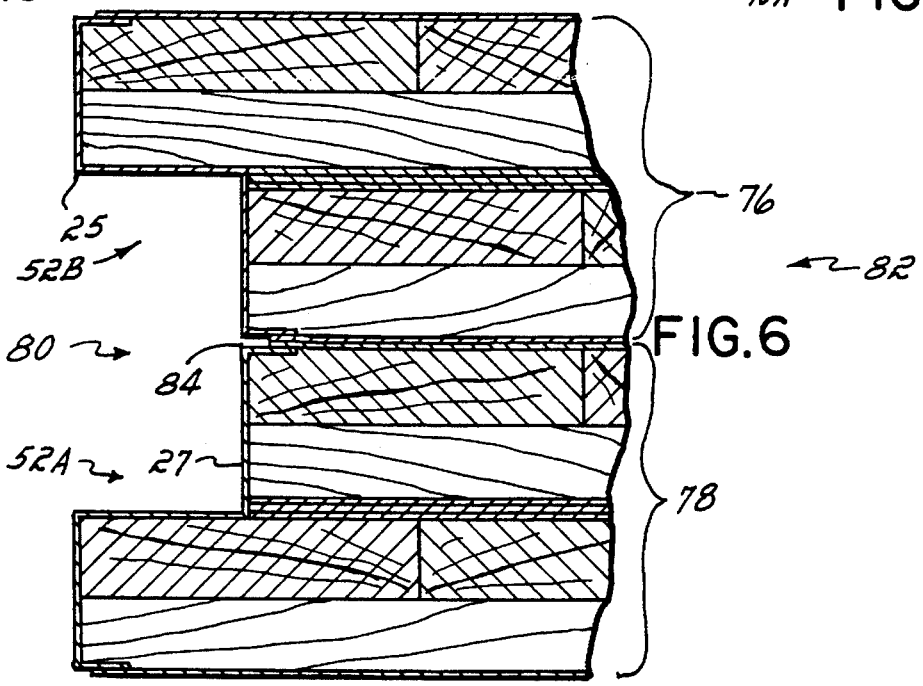
FIG. 6 is a top plan view of a reinforced panel made from two panels of the present invention placed coextensive with each other.

A four layer embodiment of the present invention 10, such as that shown in FIG. 5, may achieve a UL rating of Class 1 which signifies that it is certified to resist a penetration attempt for approximately ½ hour. In an alternative embodiment of the present invention, as shown in FIG. 6, a reinforced panel 82 is formed by placing back-to-back two identical panels 76 and 78, which utilize the construction of panel 10 of the present invention. The overall reinforced panel 82 assembled in this way has eight layers of cross-grained hardwood boards and two independent grids of nails (not shown in FIG. 6) dispersed therein. The rabbet edges of the individual panels 76 and 78 cooperate to form a tongue (not shown) and groove configuration at the edges 80 of panel 82. Reinforced panel 82 has a UL rating of Class 2 signifying its capability to resist penetration for approximately 1 hour. In this way, two Class 1 panels 10 can be used to make a reinforced Class 2 panel 82. In making a reinforced panel 82 from two panels, 76 and 78, the panels are secured together by placing ½ inch welds to the sheet metal end caps 25, 27 of the panels approximately every 6 inches along seam 84 where the rabbet edges 52A and 52B of the individual panels meet.

Therefore, the present invention provides a multi-layered vault panel for use in modular vaults or more permanent structures. The panels are lightweight, providing a weight of less than 30 pounds per square foot whereas a similar panel made of concrete weighs approximately 70 pounds per square foot. The panel of the present invention provides cross-grain hardwood layers and a metal grid of nails which permeates the layered hardwood in the panel. The nails of the grid extend at an angle from the perpendicular to the main face surfaces of the panel to reduce the probability of penetrating the panel by cutting or sawing in the major face surface of the panel between adjacent nails.

While the present invention has been illustrated by description of a preferred embodiment and while the preferred embodiment has been described in considerable detail, it is not the intention of the applicants to restrict or in any way limit the scope of the appended claims to such detail. Additional advantages and modifications will readily appear to those skilled in the art. For example, while the invention has been described as having nails which extend at an angle of 10 degrees to the perpendicular of the main face surface of the panel, a larger or smaller angle may be utilized to achieve the same objective. Additionally, more layers of boards may be added to the panel rather than the four or eight that are shown in the specific embodiments described herein. Furthermore, the spacing of individual nails in the grid may be changed without departing from the scope of the invention. The invention in its broader aspects is therefore not limited to the specific details, representative apparatus and method, and illustrative example shown and described. Accordingly, departures may be made from such details without departing from the spirit or scope of applicant's general inventive concept.

I claim:

1. A multi-layered panel for a vault structure having upper and lower spaced horizontal edges, spaced right and left vertical side edges and opposing inner and outer spaced parallel major face surfaces comprising:

a first layer generally coextensive with a major face surface of the panel;

a second layer disposed parallel to said first layer and generally coextensive with a major face surface of the panel;

a first plurality of nails extending through one major face surface and into at least one of said panel layers, and a second plurality of nails extending through the other major face surface and into at least the other of said panel layers, the nails of the first and second plurality of nails extending into the panel layers angled non-perpendicularly to the planes of the major face surfaces to create opposing first and second grids of angled nails within the panel layers, the first grid being offset from the second grid such that the nails of the first grid extend into panel gaps between adjacent nails of the second grid and the nails of the second grid extend into panel gaps between adjacent nails of the first grid to reduce the effective size of the gaps in the panel between the nails over generally the entire panel; and an anchoring structure between said first layer and said second panel layer, openings formed in at least one of said panel layers proximate said structure, said anchoring structure positioned proximate at least one of said panel edges and configured for receiving securing members so that when a batten is placed over the opposing edges of adjacent panels to hold together the panels joined to form a vault structure, securing members may be inserted through openings in the batten and through said openings in the at least one panel layer and received by the anchoring structure to provide a strengthened seam between adjacent vault panels;

whereby the penetration resistance of the seam is enhanced because the securing members are secured by the anchoring structure and are not held only by the panel layers.

2. The panel of claim 1 wherein the panel layers are wood and said anchoring structure is metal.

3. The panel of claim 1, said anchoring structure comprising:

a plurality of elongated bars, each of said bars having at least one threaded hole therein to receive a threaded securing screw, the plurality of bars collectively extending in an end-to-end fashion along substantially the entire length of the panel edge and essentially parallel to said panel edge;

whereby a securing screw may be extended through a batten opening and a panel layer opening and may be screwed into an elongated bar when a batten is used to hold adjacent panels together in a vault structure.

4. The panel of claim 1, wherein said anchoring structure comprises a continuous elongated bar which extends along substantially the entire length of the panel edge and essentially parallel to said panel edge.

5. The panel of claim 4, wherein said elongated bar has a plurality of spaced, threaded holes therein along substantially its length to receive numerous threaded securing screws along the edge of the panel;

whereby securing screws may be extended through batten openings and may be screwed into the elongated bar when a batten is used to hold adjacent panels together in a vault structure.

6. The panel of claim 1 wherein said anchoring structure is proximate every edge of said panel.

7. A multi-layered panel for a vault structure having upper and lower spaced horizontal edges, spaced right and left vertical side edges and opposing inner and outer spaced parallel major face surfaces comprising:

a first panel layer, a second panel layer, and a solid intermediate layer, the first and second panel layers each juxtaposed in solid-to-solid contact with said solid intermediate layer, each panel layer and intermediate layer generally coextensive with a major face surface of the panel;

a first plurality of nails extending through one major face surface and into at least one of said panel layers, and a second plurality of nails extending through the other major face surface and into at least another of said panel layers, the nails of the first and second plurality of nails extending into the panel layers angled non-perpendicularly to the planes of the major face surfaces to create opposing first and second grids of angled nails within the panel layers, the first grid being offset from the second grid such that the nails of the first grid extend into panel gads between adjacent nails of the second grid and the nails of the second grid extend into panel gaps between adjacent nails of the first grid to reduce the effective size of the gaps in the panel between the nails over generally the entire panel;

an anchoring structure between said first panel layer and said second panel layer, openings formed in at least one of said panel layers proximate said structure, said anchoring structure positioned proximate at least one of said panel edges and comprising at least one elongated bar, said elongated bar having at least one threaded hole therein for receiving threaded securing screws so that when a batten is placed over the opposing edges of adjacent panels to hold together the panels joined to form a vault structure, securing screws may be inserted through openings in the batten and through said openings in the at least one panel layer and threaded into the elongated bar to provide a strengthened seam between adjacent vault panels;

whereby the penetration resistance of the seam is enhanced because the securing screws are secured by the elongated bar and are not held only by the panel layers.

8. The panel of claim 7 wherein the panel layers are wood and said elongated bar is metal.

9. The panel of claim 7 further comprising:

a plurality of elongated bars, each of said bars having at least one threaded hole therein for receiving a threaded securing screw, the plurality of bars collectively extending in an end-to-end fashion along substantially the entire length of the panel edge and essentially parallel to said panel edge;

whereby a securing screw extends through a batten opening and through a panel layer opening and is screwed into an elongated bar when a batten is used to hold adjacent panels together in a vault structure.

10. The panel of claim 7 wherein said anchoring structure comprises a continuous elongated bar which extends along substantially the entire length of the panel edge and essentially parallel to said panel edge.

11. The panel of claim 10 wherein said elongated bar has a plurality of spaced, threaded holes therein along substantially its length to receive numerous threaded securing screws along the edge of the panel;

whereby securing screws may be extended through batten openings through panel layer openings and may be screwed into the elongated bar when a batten is used to hold adjacent panels together in a vault structure.

12. The panel of claim 7 wherein said anchoring structure is proximate every edge of said panel.

13. A method for making a multi-layered panel for a vault structure having upper and lower edges, spaced right and left vertical side edges and opposing inner and outer spaced parallel major face surfaces comprising the steps of:

disposing a first plurality of boards in a first direction and adjacent to one another to form a first panel layer;

disposing at least one additional plurality of boards on top of the first plurality of boards to form a second panel layer which overlies the first panel layer; the boards of the second panel layer being disposed adjacent to one another and in a direction perpendicular to the first plurality of boards;

positioning a solid intermediate layer between the first and second panel layers such that the panel layers are each juxtaposed in solid-to-solid contact with said solid intermediate layer;

placing an anchoring structure between said first panel layer and said second panel layer proximate at least one of said panel edges and proximate openings formed in at least one of said panel layers, the anchoring structure comprising at least one elongated bar having at least one threaded hole therein for receiving threaded securing screws so that when a batten is placed over the opposing edges of adjacent panels to hold together the panels joined to form a vault structure, securing screws may be inserted through openings in the batten and through said openings in the at least one panel layer and threaded into the elongated bar to provide a strengthened seam between adjacent vault panels;

driving a first plurality of nails into the panel such that each nail penetrates at least two adjacent layers, the nails of the first plurality being driven into one major face surface of the panel angled non-perpendicularly to the plane of the face surface to create a first grid of angled nails within the layers of the panel, driving a second plurality of nails into the panel such that each nail penetrates at least two adjacent layers, the nails of the second plurality being driven into the other major face surface of the panel angled non-perpendicularly to the plane of the other face surface to create a second grid of angled nails, the second grid being offset from the first grid and opposing the first grid such that the nails of the first grid extend into panel gaps between adjacent nails of the second grid and the nails of the second grid extend into panel gaps between adjacent nails of the first grid to reduce the effective size of the gaps in the panel between the nails over generally the entire panel;

whereby the penetration resistance of the seam is enhanced because the securing screws are secured by the elongated bar and are not held only by the panel layers.

14. The method of claim 13 wherein the panel layers are wood and said anchoring structure is metal.

15. The method of claim 13 wherein said anchoring structure comprises a plurality of elongated bars, each of said bars having at least one threaded hole therein to receive a threaded securing screw, the plurality of bars collectively extending in an end-to-end fashion along substantially the entire length of the panel edge and essentially parallel to said panel edge;

whereby a securing screw may be extended through a batten opening and may be screwed into an elongated bar when a batten is used to hold adjacent panels together in a vault structure.

16. The method of claim 13 wherein said anchoring structure comprises a continuous elongated bar which extends along substantially the entire length of the panel edge and essentially parallel to said panel edge.

17. The method of claim 16 wherein said elongated bar has a plurality of spaced, threaded holes therein along substantially its length to receive numerous threaded securing screws along the edge of the panel;

whereby securing screws may be extended through a batten opening and may be screwed into the elongated bar when a batten is used to hold adjacent panels together in a vault structure.

18. The method of claim 13 wherein said anchoring structure is proximate every edge of said panel.

* * * * *

UNITED STATES PATENT AND TRADEMARK OFFICE

CERTIFICATE OF CORRECTION

PATENT NO. : 5,469,796

DATED : Nov. 28, 1995

INVENTOR(S) : Koenig

It is certified that error appears in the above-identified patent and that said Letters Patent is hereby corrected as shown below:

Column 4, line 29, Fig 1A, please delete the words "fight side" and insert --right side--.

Column 5, line 31, please delete the words "a fight" and insert --a tight--.

Column 6, line 31, please delete the words "and lib" and insert ---and 11B--.

Column 7, line 45, please insert a period after the words "striking a nail".

Column 14, claim 7, line 65, please delete the word "gads" and insert --gaps--.

Signed and Sealed this

Eleventh Day of June, 1996

Bruce Lehman

*Attest:*

BRUCE LEHMAN

*Attesting Officer*

*Commissioner of Patents and Trademarks*